US007335139B2

(12) United States Patent
Bartholomew et al.

(10) Patent No.: US 7,335,139 B2
(45) Date of Patent: Feb. 26, 2008

(54) INCREMENTAL WEIGHT SYSTEM

(75) Inventors: Ricky J. Bartholomew, Owatonna, MN (US); Arnold B. Gillen, Faribault, MN (US)

(73) Assignee: Cybex International, Inc., Medway, MA (US)

( * ) Notice: Subject to any disclaimer, the term of this patent is extended or adjusted under 35 U.S.C. 154(b) by 380 days.

(21) Appl. No.: 10/293,101

(22) Filed: Nov. 13, 2002

(65) Prior Publication Data

US 2003/0092542 A1 May 15, 2003

Related U.S. Application Data

(60) Provisional application No. 60/337,849, filed on Nov. 13, 2001.

(51) Int. Cl.
*A63B 21/08* (2006.01)

(52) U.S. Cl. ..... 482/97; 482/96

(58) Field of Classification Search ..... 482/95–97, 482/105–108, 100–101
See application file for complete search history.

(56) References Cited

U.S. PATENT DOCUMENTS 4,627,615 A 12/1986 Nurkowski
5,580,341 A 12/1996 Simonson
5,597,375 A 1/1997 Simonson
5,616,107 A 4/1997 Simonson
5,662,131 A * 9/1997 Scarborough et al. ..... 135/65
5,769,762 A 6/1998 Towley, III et al.
5,776,040 A * 7/1998 Webb et al. ..... 482/98
5,876,313 A 3/1999 Krull
5,935,048 A 8/1999 Krull
5,944,642 A 8/1999 Krull
5,971,899 A 10/1999 Towley, III et al.
6,033,350 A 3/2000 Krull
6,083,144 A 7/2000 Towley, III et al.
6,090,020 A * 7/2000 Webber ..... 482/100
6,174,265 B1 * 1/2001 Alessandri ..... 482/5
6,183,401 B1 2/2001 Krull
6,387,018 B1 * 5/2002 Krull ..... 482/98
6,387,019 B1 5/2002 Krull
6,387,021 B1 5/2002 Miller, Jr.
6,416,446 B1 7/2002 Krull (Continued)

*Primary Examiner*—Lori Amerson
(74) *Attorney, Agent, or Firm*—Rissman Jobse Hendricks & Oliverio

(57) ABSTRACT

The present invention provides an incremental weight system for use with a weight stack of an exercise machines. As described herein, the incremental weight system enables users to incrementally increase the lifting weight, by adding weights that weigh less then the weight of a weight block. The incremental weight system is integrated onto the top of the weight stack, having a weight selector handle operable connected to a pair of engagement pins. The weight selector handle enables the engagement pins to be extended from and retracted into the assembly housing as the weight selector handle is rotated. Incremental weights are disposed at opposite ends of the weight stack. By rotating the weight selector handle, the engagement pins are extended from the assembly housing and engage the increment weights. The engagement pins engage the incremental weight by being inserted through the incremental weight receiving slots, such that, as the weight stack moves up and down, any selected incremental weights move in unison with the weight stack. If an incremental weight is not engaged by the engagement pin, the incremental weight will remain in position, while the rest of the selected incremental weights move unison with the weight stack.

21 Claims, 9 Drawing Sheets

U.S. PATENT DOCUMENTS 6,436,013 B1 8/2002 Krull
6,447,432 B1 * 9/2002 Krull ..... 482/98
6,468,189 B2 10/2002 Alessandri
6,666,800 B2 12/2003 Krull
2002/0049123 A1 4/2002 Krull
2003/0166439 A1 * 9/2003 Giannelli ..... 482/100
2003/0176224 A1 * 9/2003 Armitage et al. ..... 464/180
2004/0220025 A1 * 11/2004 Krull ..... 482/94

* cited by examiner

INCREMENTAL WEIGHT SYSTEM

CROSS-REFERENCE TO RELATED APPLICATION

This application is related to and claims priority to U.S. Provisional Application Ser. No. 60/337,849, filed Nov. 13, 2001, entitled INCREMENTAL WEIGHT SYSTEM, the entirety of which is incorporated herein by reference.

STATEMENT REGARDING FEDERALLY SPONSORED RESEARCH OR DEVELOPMENT n/a

FIELD OF THE INVENTION

The present invention relates to exercise equipment, and in particular, to a system for selecting incremental amounts of weight in a weight lifting apparatus.

BACKGROUND OF THE INVENTION

Among the most effective of weight training, or "strength", machines are those which employ a stack of modular blocks or plates which a user may manually set within a range of weight. The weight stack is typically formed by a stack of rectangular, brick-shaped weight blocks, stacked vertically, wherein one or more rods may be slideably disposed within a vertical channel formed within the stack by a set of vertically aligned holes in each weight block. An additional lifting post is usually disposed in another such channel, typically in the center of the weight stack, such lifting post being further coupled to an assembly of cables and pulleys for actuation by the user. Each block further has at least one horizontal channel or hole, wherein a pin may be disposed to slideably engage any of a series of horizontal channels which are vertically oriented on the lifting post in a spaced apart manner to match the vertical spacing of the stacked weight blocks. The pin thereby engages a portion of the stack of weight blocks, such that when vertical force is applied to the lifting post, the selected stack of weight blocks is moved upwards to create a resistance for use in weight or strength training. Typically, the weight stack apparatus is oriented such that the further down the pin is entered into the lifting post, the greater the number of weight blocks are engaged, thereby increasing the resistance of the machine for use in weight training.

However, effective strength training requires that the weight resistance be selectable to a relatively high degree of resolution. The initial baseline resolution of the weight stack is equal to the weight of an individual weight block, i.e., the resistance may only be varied in increments equal to the weight of an individual weight block. Thus, to increase resolution, the individual weight blocks must be lighter. However, if the aggregate weight of the stack is to be high enough to provide adequate resistance for heavy weight training, and the apparatus is to be compact, the weight blocks cannot be too light. The other option would be to increase the number of blocks in each stack, but design and manufacturing considerations dictate that the number of parts in any apparatus be minimized.

To increase the weight resistance resolution, while providing a sufficiently compact and heavy weight stack, with a minimum number of parts, several different devices and mechanisms have been employed. One involves the placement of incremental weights, having a weight smaller than one of the weight blocks in the stack, directed onto, or in fixed connection with, a portion of the weight stack. The incremental weight may be placed directly on top of the weight stack. Or it may be attached to a portion of the pin extruding from the weight stack. However these options require that additional parts be utilized with the apparatus. These parts may be lost, or may be dropped to cause injury. Furthermore, the incremental weights may shift the center of gravity of the weight stack or otherwise disrupt the balance and weight distribution of the stack around the guiding rods. Another problem is that the incremental weight causes components of the apparatus to bend, thereby placing undesired stress, strain, and torque on the tightly interconnected moving parts, leading to decreased machine safety, efficiency and performance. Finally, in order to increase the safety of such devices, it is usually desirable to provide a weight stack apparatus that is fully enclosed, such that bodies cannot enter the spaces and junctions between the weight blocks and rods during operation.

Therefore, it is desirable to provide for a system of incremental weights which may be employed in a conventional weight stack type exercise machine, whereby the incremental weights do not disrupt the balance of the machine, do not require the use of additional detachable parts, and may be safely enclosed within a covering structure.

SUMMARY OF THE INVENTION

The present invention provides an incremental weight system for use with a weight stack of an exercise machines. As described herein, the incremental weight system enables users to incrementally increase the lifting weight, by adding weights that weigh less then the weight of a weight block.

In an exemplary exercise machine the weight stack is supported in a weight stack support frame, where the weight stack is slidingly mounted on a pair of vertical rails. The weight stack is operably connected to the exercise machine's input assembly by a lifting cable, and a series of pulleys, as is well known in the art.

The incremental weight system of the present invention is integrated onto the top of the weight stack, where the incremental weight system includes a weight assembly housing affixed to the lifting post and containing a cable attachment for attaching to the lifting cable. As with the weight stack, the weight assembly housing is slidingly mounted on the vertical rails within the weight stack support frame, where the vertical rails are disposed through the vertical rail guides. A weight selector handle is positioned on the front face of the assembly housing, and is operable connected to the engagement pin, enabling the engagement pins to be extend from and retracted into the assembly housing as the weight selector handle is rotated.

For example, the engagement pins are retracted into the assembly housing when the weight selector handle is in a substantially vertical position. As the weight selector handle is rotated clock-wise the engagement pins are extended from the assembly housing. Conversely, as the weight selector handle is rotated counter clock-wise the engagement pins are retracted into the assembly housing.

The incremental weights are disposed at opposite ends of the weight stack. By rotating the weight selector handle, the engagement pins are extended from the assembly housing and engage the incremental weights. The engagement pins engage the incremental weight by being inserted through the incremental weight receiving slots, such that, as the weight stack moves up and down, and any selected incremental weights moves in unison with the weight stack. If an incremental weight is not engaged by the engagement pin the incremental weight will remain in position, while the rest of the selected incremental weights move unison with the weight stack.

To engage the appropriate incremental weights, the weight selector handle is a spring loaded rotateable detent pin, wherein the detent pin engages a faceplate affixed to the assembly housing front face. The faceplate includes a plurality of detent pinholes for engagement by the detent pin, where the pinholes correspond to the number of incremental weights engaged by each engagement pin.

For example, when there are three incremental weights on each side of the weight stack, the detent pinholes are labeled "0" to "3." When the detent pin is rotated to the "0" position no weights are engage by the engagement pin. When the detent pin is rotated to the "3" position three weight are engaged by each engagement pin.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention provides an incremental weight system for use with a weight stack of an exercise machine. As described herein, the incremental weight system enables users to symmetrically load a weight stack with symmetric pairs of incremental weights.

Figure 1:
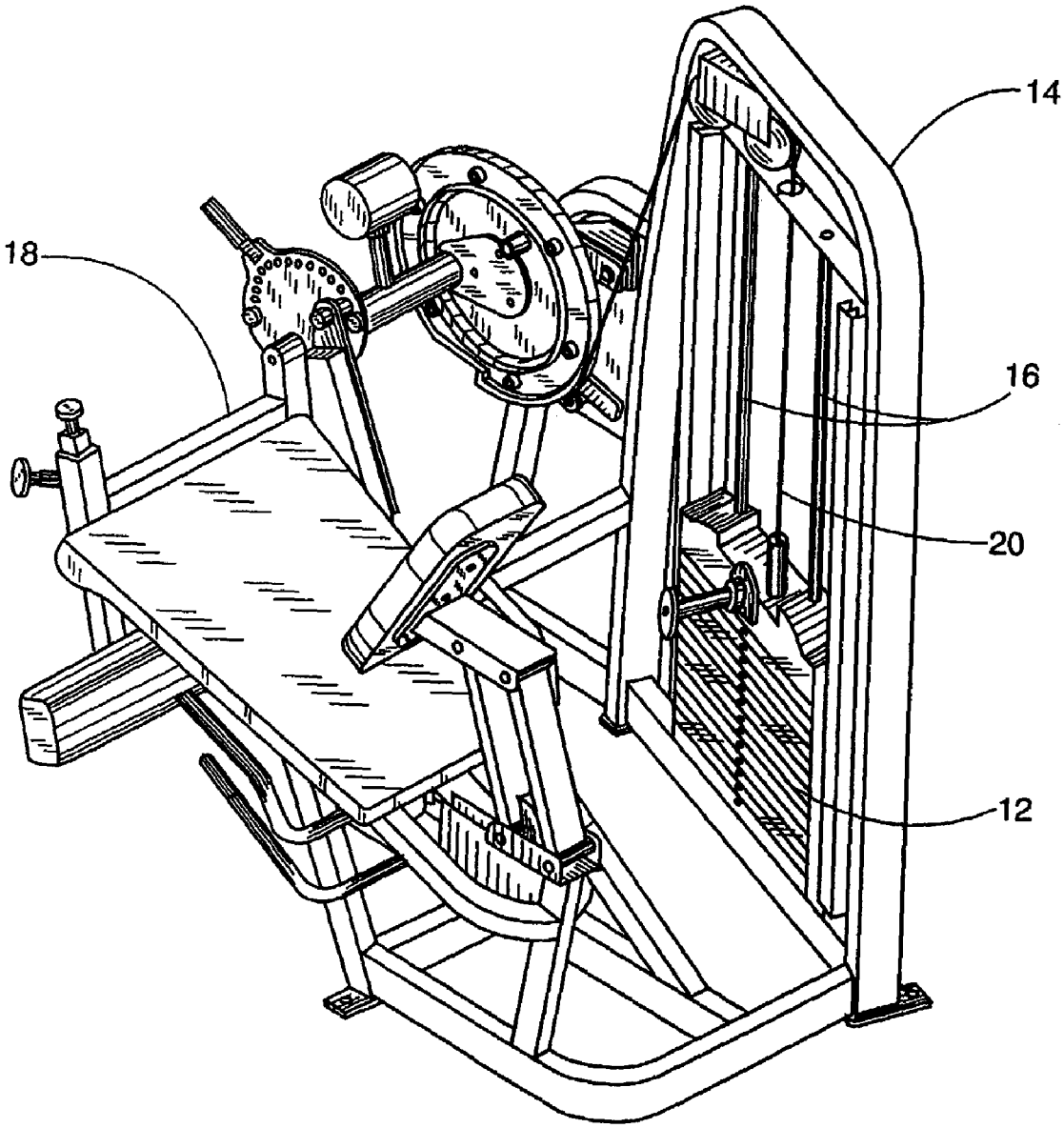
FIG. 1 is a perspective view of an exemplary exercise machine.

The incremental weight system can be more fully understood when described in conjunction with an exemplary exercise machine. As shown in FIG. 1, exemplary exercise machine includes weight stack 12 supported in a weight stack support frame 14, where the weight stack 12 is slidingly mounted on a pair of vertical rails 16. The weight stack 12 is operably connected to the exercise machine's 10 input assembly 18 by a lifting cable 20, and a series of pulleys, as is well known in the art.

Figure 2:
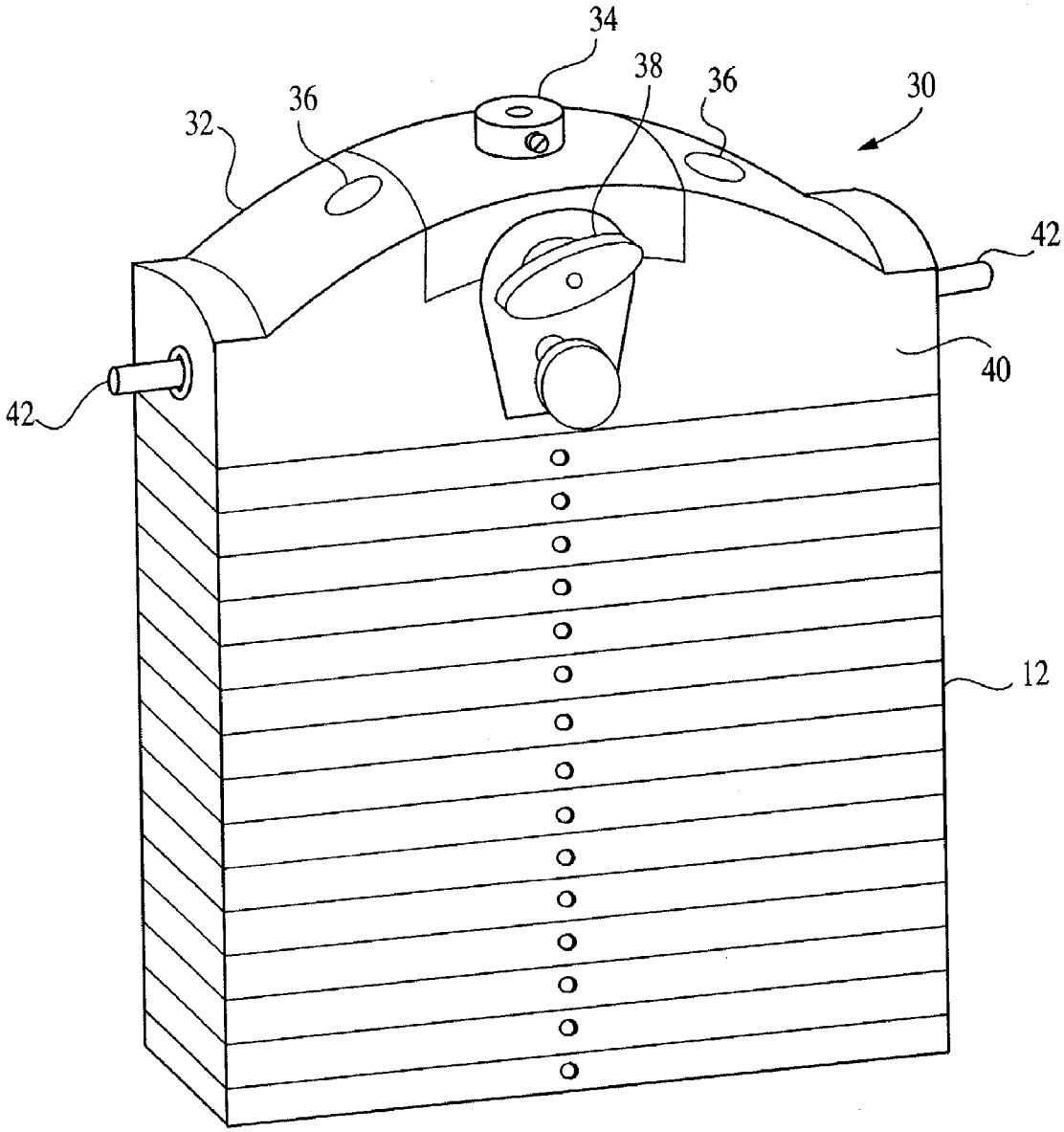
FIG. 2 is a perspective view of the incremental weight system of the subjected invention incorporated onto a weight stack.
Figure 3:
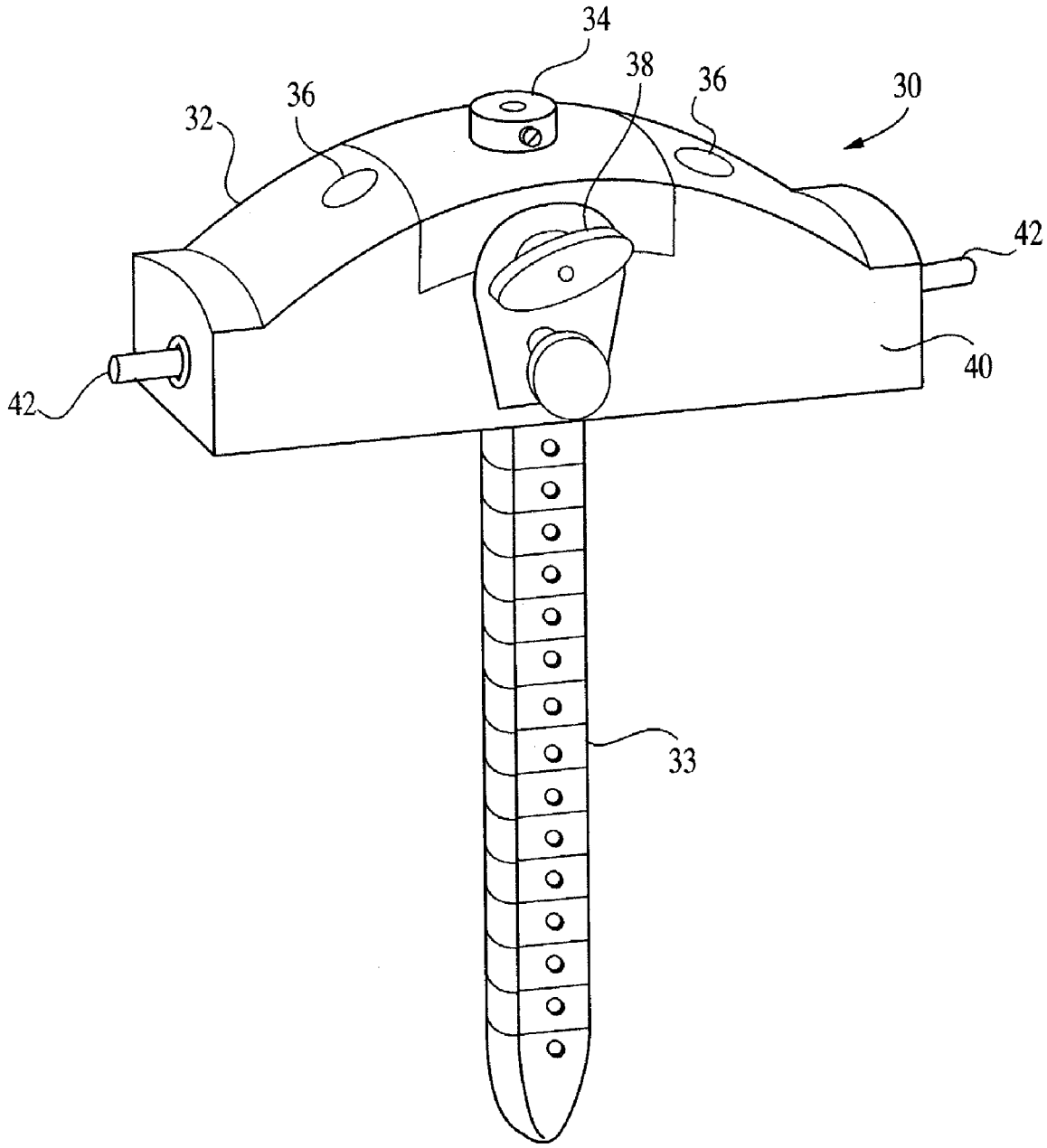
FIG. 3 is a is a perspective view of the incremental weight system of the subjected.

As shown in FIGS. 2 and 3, the incremental weight system 30 of the present invention is integrated onto the top of the weight stack 12. The incremental weight system 30 includes a weight assembly housing 32 affixed to the lifting post 33 and containing a cable attachment 34 for attaching to the lifting cable 20. As with the weight stack 12, the weight assembly housing 32 is slidingly mounted on the vertical rails 16 within the weight stack support frame 14, where the vertical rails 16 are disposed through the vertical rail guides 36. A weight selector handle 38 is positioned on the front face 40 of the assembly housing 32, and is operably connected to a pair of longitudinally, extending engagement pins 42, as described in further detail below.

Figure 4:
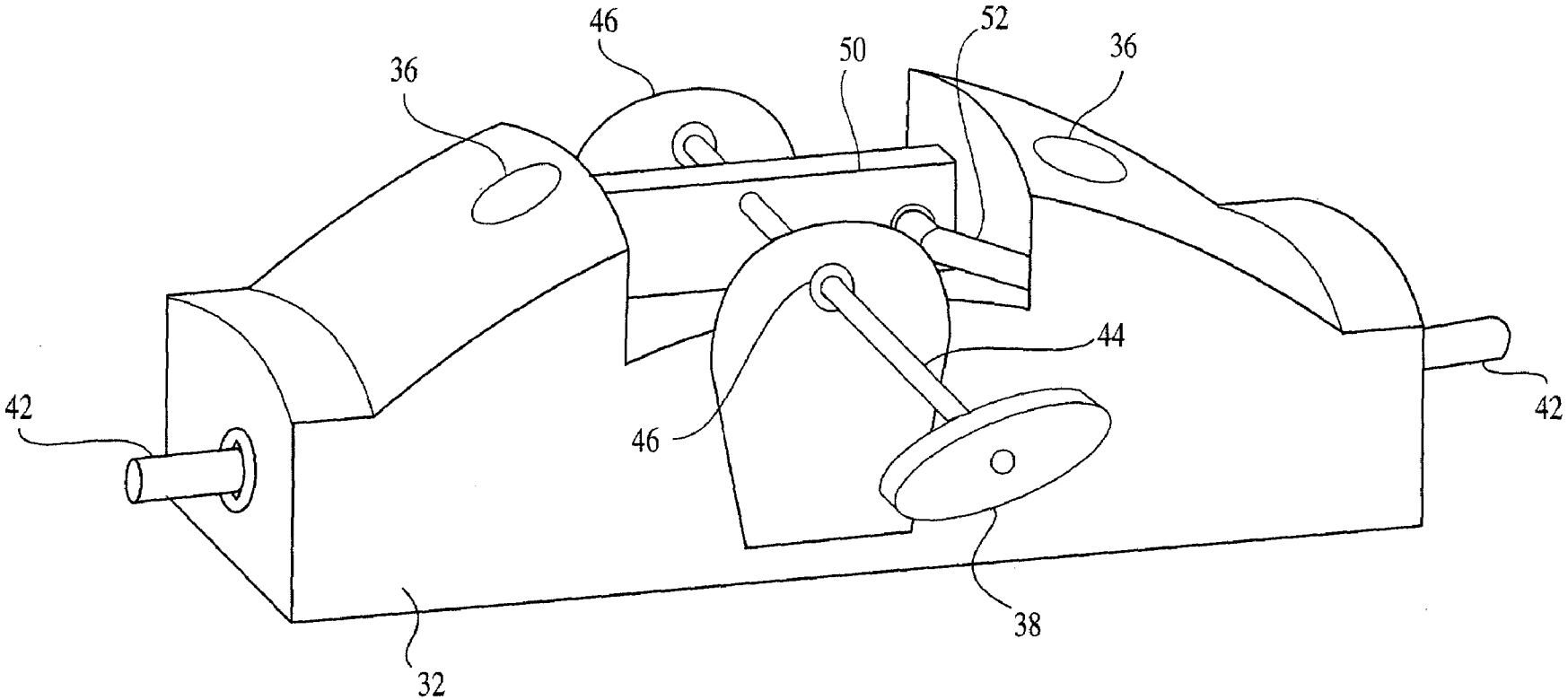
FIG. 4 is a perspective view of the assembly housing of the subject invention.
Figure 5:
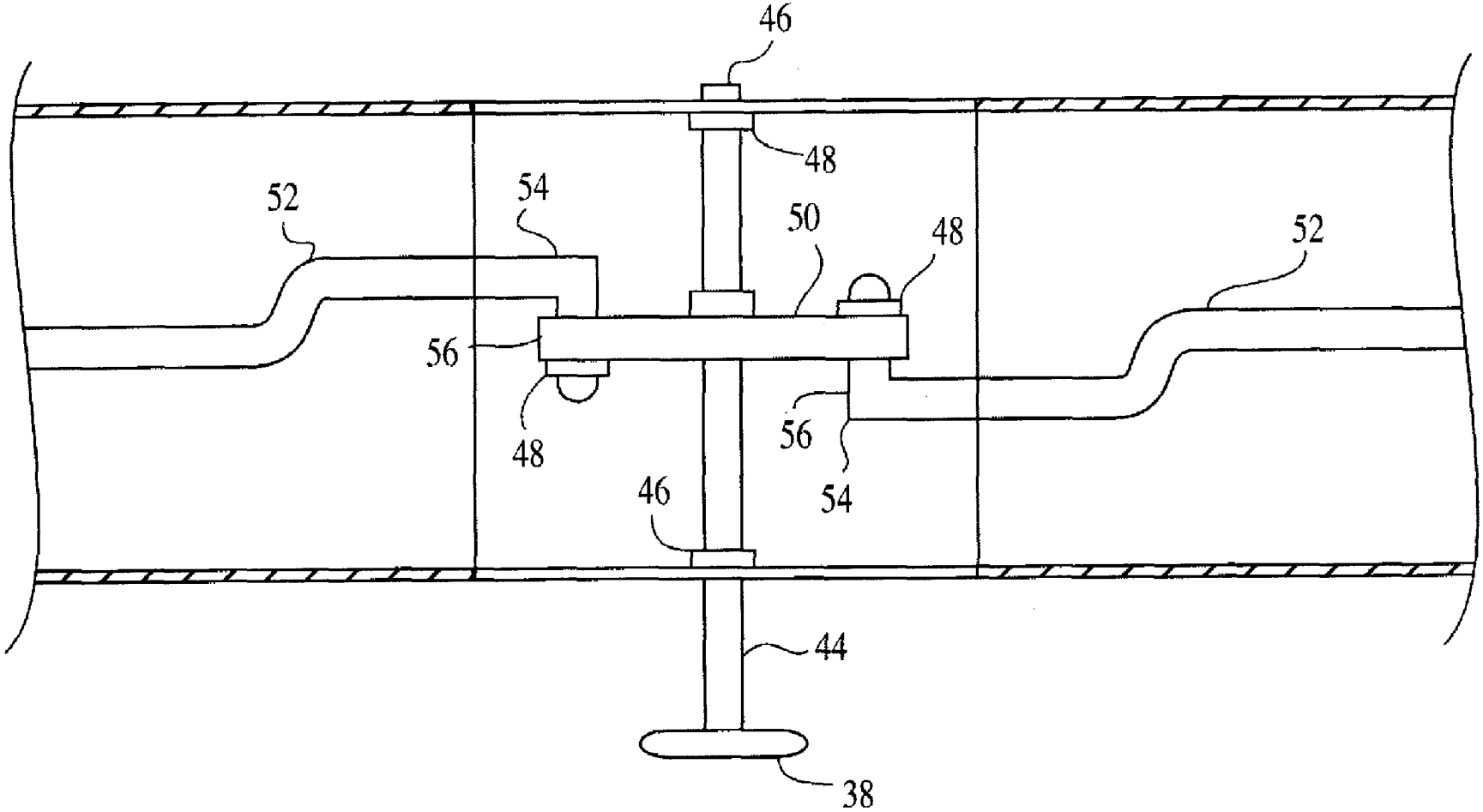
FIG. 5 is a top sectional view of the assembly housing of the subject invention.

As shown in FIGS. 4 and 5, the weight selector handle 38 is connected to a selector rod 44, where the selector rod 44 is pivotally attached to the assembly housing 32 through the rod guides 46 with, for example, retaining rings 48. A central hub 50 is attached to the selector rod 44, and disposed within the assembly housing 32, such that as the weight selector handle 38 is rotated the central hub 50 rotates. A pair of linkage rods 52 are pivotally attached to opposite ends of the central hub 50, where the linkage rods 52 include proximal and distal ends. The proximal ends of the linkage rods 52 contain hub attachments 54 for insertion into the hub guide holes 56 and the distal ends containing engagement pin attachments 58. (See also FIG. 6). The linkage rods 52 are pivotally connected to opposite ends of the central hub 50 by inserting the hub attachments 54 into the hub guide holes 56 and securing with, for example, retaining ring 48.

Figure 6:
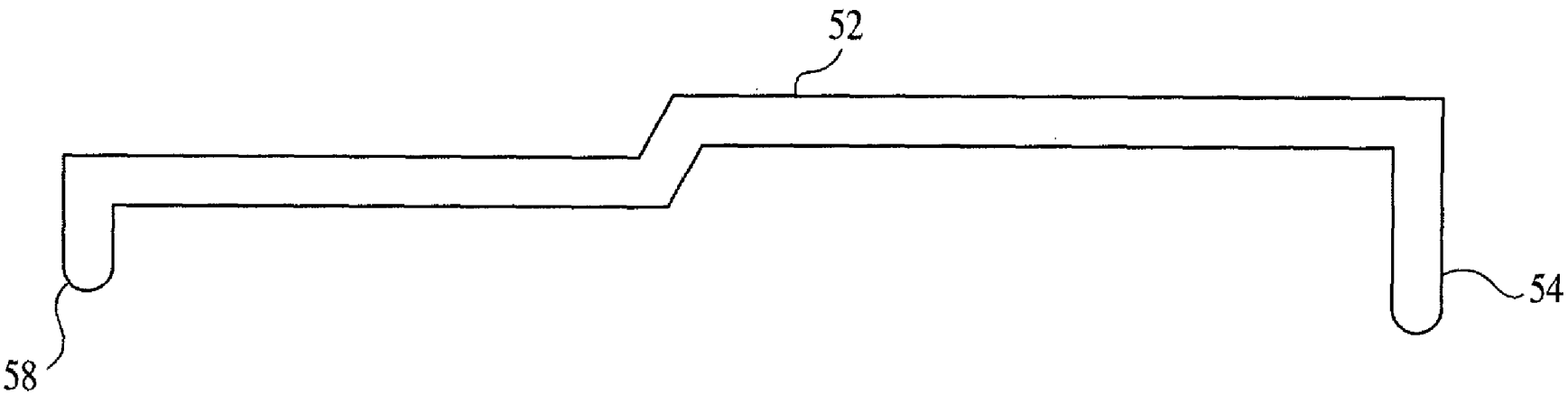
FIG. 6 is a top view of a linkage rod of the subject invention.
Figure 7:
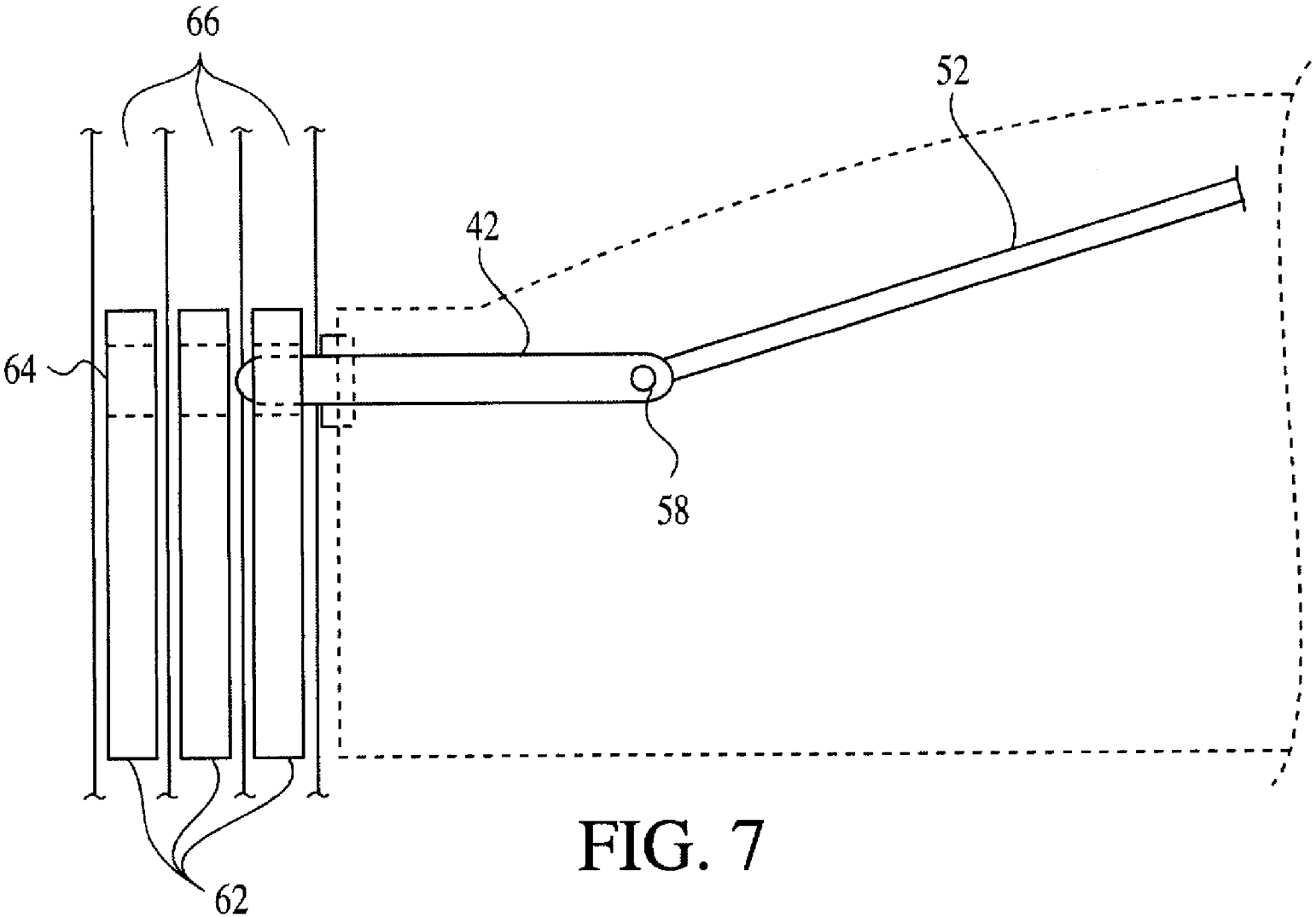
FIG. 7 is a side sectional view of the engagement pin and incremental weights of the subject invention.

As shown in FIGS. 6 and 7, the distal ends of the linkage rods 52 are pivotally connected to the engagement pins 32 by inserting the engagement pin attachments 58 through the engagement pin guide holes 60 and securing with, for example, retaining ring 48. The pivotal connection of the linkage rods 52 to the central hub 50 and engagement pins 42 enable the engagement pins 42 to be symmetrically, longitudinally extended from and retracted into the assembly housing 32 as the weight selector handle 38 is rotated.

Figure 8C:
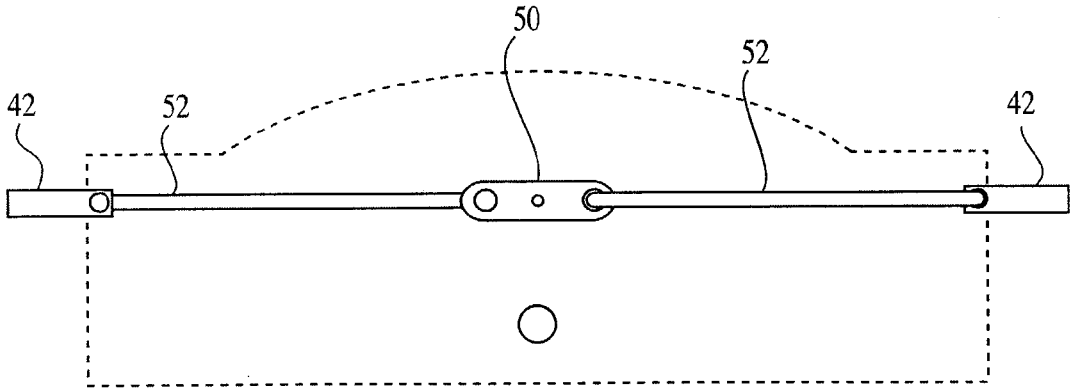
FIGS. 8*a*-8*c* are side sectional views of the assembly housing with the engagement pin in various positions.
Figure 8B:
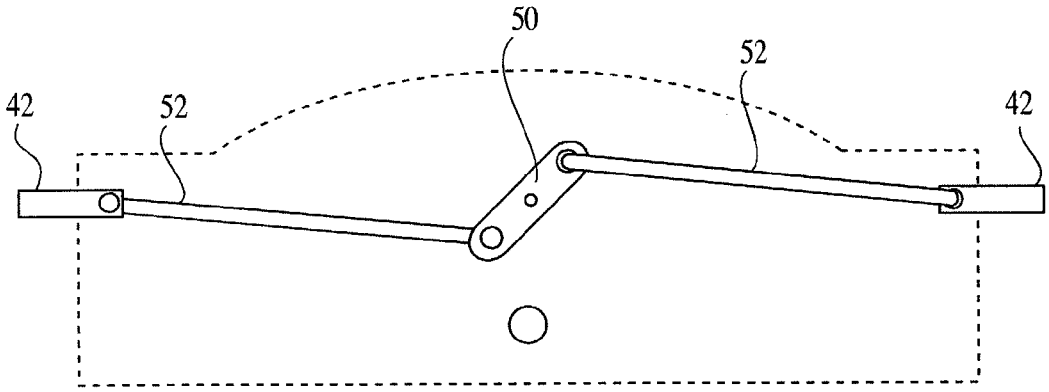
Figure 8A:
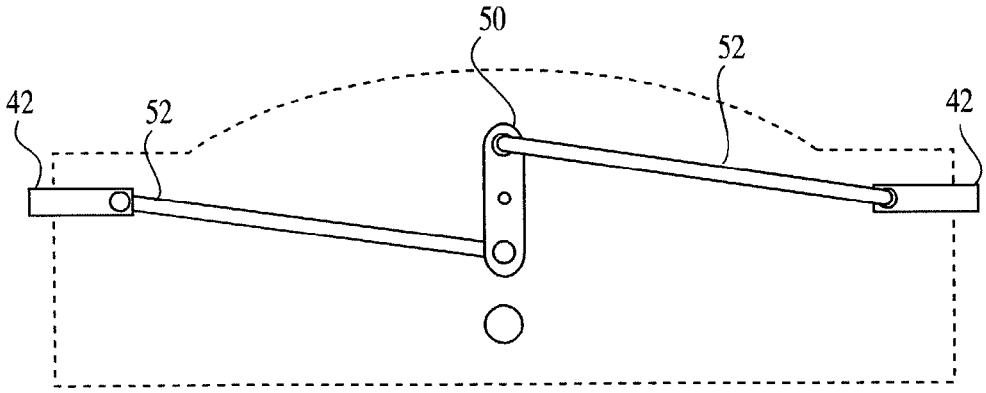

As shown in FIGS. 8*a*-8*c*, the engagement pins 42 are retracted into the assembly housing 32 when the weight selector handle 38, and central hub 50, are in a substantially vertical position. As the weight selector handle 38 is rotated clock-wise, the central hub 50 rotates clockwise, extending the engagement pins 42 from the assembly housing 32. Conversely, as the weight selector handle 38 is rotated counter clock-wise the engagement pins 42 are retracted into the assembly housing 32.

The central hub 50, linkage rods 52, and engagement pins 42 are operably connected such that the engagement pins 42 are extended from the assembly housing 32 as the weight selector handle 38 is rotated counter clock-wise. Conversely, as the weight selector handle 38 is rotated clock-wise the engagement pins 42 are retracted into the assembly housing 32.

As shown in FIG. 7, the incremental weights 62 are disposed at opposite ends of the weight stack 12. By rotating the weight selector handle 38, the engagement pins 42 are extended from the assembly housing 32 and engage the increment weights 62. The engagement pins 42 engage the incremental weights 62 by being inserted through the incremental weight receiving slots 64, such that, as the weight stack 12 moves up and down, any selected incremental weight 62 moves in unison with the weight stack 12. If an incremental weight 62 is not engaged by the engagement pin 42, the incremental weight 62 will remain in position while the rest of the selected incremental weights 62 move in unison with the weight stack 12.

In an embodiment, as shown in FIG. 7, the incremental weights 62 are disposed within guide rails 66, such that, as the selected incremental weights 62 move up with the weight stack 12, the incremental weights 62 slide within the guide rails 66.

In the embodiment shown in FIG. 7, three incremental weights 62 are disposed on opposite sides of the weight stack 12. However, any number of incremental weights 62 would be in the purview of the present application.

Furthermore, while the exemplary embodiment employs monolithic incremental weight 62, substantially prismatic in shape and form, a number of alternative shapes or configurations may be used to achieve the purpose and function of the present invention.

Figure 9:
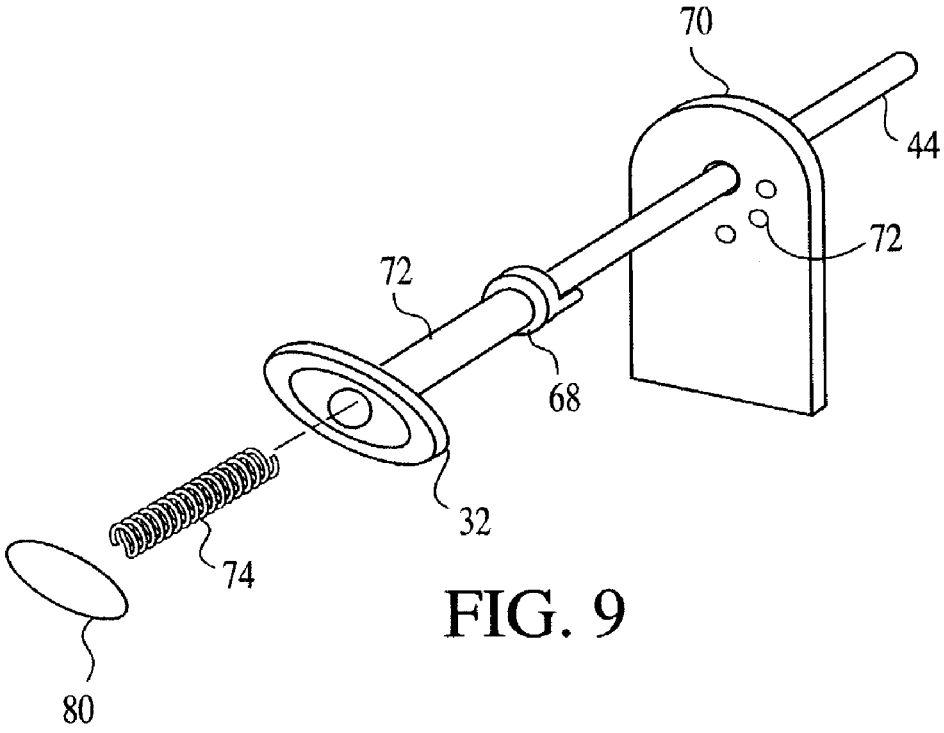
FIG. 9 is a perspective exploded view of the detent pin weight selector handle of the subject invention.
Figure 10:
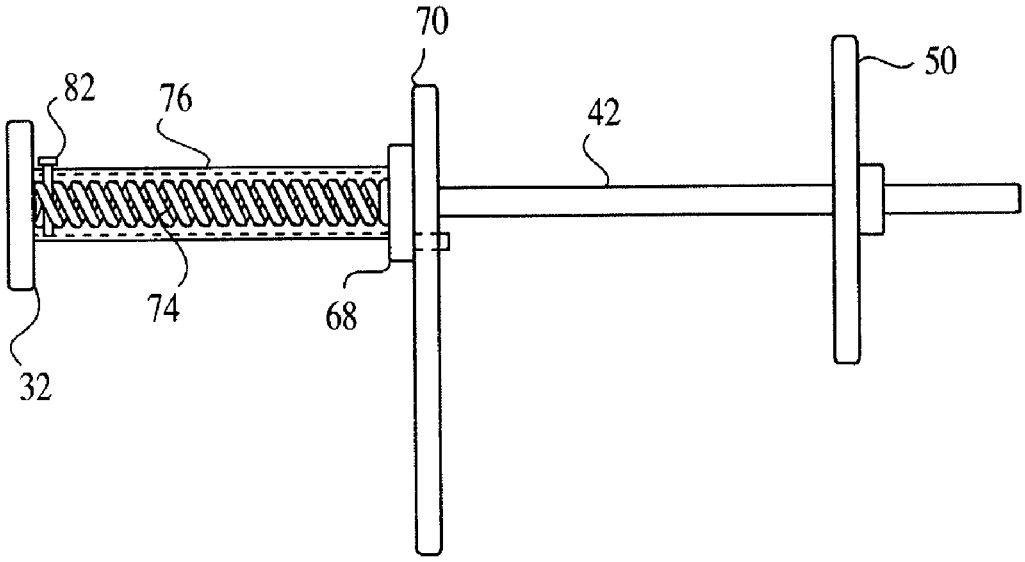
FIG. 10 is a side sectional view of the detent pin weight selector handle of the subject invention.

In an alternative embodiment, as shown in FIGS. 9 and 10, the weight selector handle 38 is a spring loaded rotateable detent pin 68, wherein a spring 74 is secured within the detent pin housing 76 with a cover plate 80 and pin 82. The detent pin 68 is attached to the selector rod 44 and engages a faceplate 70 affixed to the assembly housing front face 40. The faceplate 70 includes a plurality of adjustment holes 72 for engagement by the detent pin 68, where the adjustment holes 72 correspond to the number of incremental weights 62 engaged by each engagement pins 42.

In the illustrated embodiment, when there are three incremental weights on each side of the weight stack 12, the adjustment holes 72 are labeled "0" to "3." When the detent pin 68 is rotated to the "0" position, no weights are engaged by the engagement pin 42. When the detent pin 68 is rotated to the "3" position, three weights are engaged by each engagement pin 42.

In an alternative embodiment, the adjustment holes 72 are labeled to indicate the weight being added to the weight stack 12. For example, when the detent pin 68 is rotated to the "0" position no weights are engage by the engagement pin 42. When the detent pin 68 is rotated to the "6" position six pounds of weight is added to the weight stack 12.

All of the components of the present invention are manufactured from the conventional materials used in exercise machines. The assembly housing 32 is preferably made of plastic or some other resilient hard polymer. The incremental weights are preferably made of metal, such as steel, and the various pieces and components of the locking hub, wire linkages, and engaging pins are manufactured from metal or polymers suited to withstand the stresses and strains of operating the apparatus as disclosed herein, as is well known to those skilled in the art.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An exercise machine comprising:

a weight stack support frame; and a plurality of weight block slidingly mounted within the weight stack support frame;

an incremental weight system mounted within the weight stack support frame, including a lifting post for selectively engaging the weight blocks and a pair of incremental weight sets positioned on opposing ends of the weight blocks, each incremental weight set including a plurality of weights that are selectively, symmetrically engageable.

2. The exercise machine according to claim 1, wherein the incremental weight sets are mounted in guide rails.

3. The exercise machine according to claim 1, wherein the incremental weight system further comprises a pair of symmetrically, longitudinal, extendable engagement pins, wherein the engagement pins selectively, symmetrically engage the pairs of incremental weights.

4. The exercise machine according to claim 3, wherein the engagement pins are actuated by a weight selector handle.

5. The exercise machine according to claim 4, wherein the weight selector handle is a spring-loaded detent pin, wherein the detent pin engages a faceplate mounted to the incremental weight system.

6. The exercise machine according to claim 5, wherein the faceplate is labeled to indicate the number of incremental weights being engaged.

7. The exercise machine according to claim 5, wherein the faceplate in labeled to indicate the weight of the incremental weights being engaged.

8. A weight stack for use with an exercise machine comprising;

a plurality of weight blocks; and an incremental weight system, including a lifting post for selectively engaging the weight blocks and a pair of incremental weights positioned on opposing ends of the weight blocks, each set of incremental weights including a plurality of weights that are selectively, symmetrically engageable.

9. The weight stack according to claim 8, wherein the incremental weight system further comprises a pair of symmetrically, longitudinal, extendable engagement pins, wherein the engagement pins selectively, symmetrically engage the pairs of incremental weights.

10. The exercise machine according to claim 9, wherein the engagement pins are actuated by a weight selector handle.

11. The exercise machine according to claim 10, wherein the weight selector handle is a spring-loaded detent pin, wherein the detent pin engages a faceplate mounted to the incremental weight system.

12. An incremental weight system for use with an exercise machine comprising:

a lifting post for selective engaging weight blocks; and a pair of incremental weight sets positioned on opposite ends of the weight blocks, each incremental weight set including a plurality of weights that are symmetrically, selective engageable.

13. The incremental weight system to claim 12, further comprises a pair of symmetrically, longitudinal, extendable engagement pins, wherein the engagement pins selectively, symmetrically engage the incremental weight sets.

14. The incremental weight system to claim 13, wherein the engagement pins are actuated by a weight selector handle.

15. The incremental weight system to claim 14, wherein the weight selector handle is a spring-loaded detent pin, wherein the detent pin engages a faceplate mounted to the incremental weight.

16. The incremental weight system to claim 15, wherein the faceplate in labeled to indicate the number of incremental weights being engaged.

17. The incremental weight system to claim 15, wherein the faceplate in labeled to indicate the amount of incremental weights being engaged.

18. An incremental weight system for use with an exercise machine comprising a means for symmetrically loading a primary weight stack with symmetric pairs of weights.

19. The incremental weight system according to claim 18, wherein the means for symmetrically loading a primary weight stack with symmetric pairs of weights comprises a lifting post for selectively engaging the primary weight stack.

20. The incremental weight system according to claim 18, wherein the means for symmetrically loading a primary weight stack with symmetric pairs of weights comprises a pair of symmetrically, longitudinal, extendable engagement pins, wherein the engagement pins selectively, symmetrically engage the symmetric pairs of weights.

21. An incremental weight system for use with an exercise machine comprising:

a lifting post extending vertically through a set of first weight blocks for selective engagement with the lifting post; and a set of second weight blocks comprising a plurality of weights that are engageable and interconnectable to the lifting post in a disposition horizontal to the first weight blocks.

* * * * *